US007588663B2

(12) United States Patent
Skoog et al.

(10) Patent No.: US 7,588,663 B2
(45) Date of Patent: Sep. 15, 2009

(54) MULTIPLE MODE HEADBOX

(75) Inventors: Henry Skoog, Roswell, GA (US); James W. Clark, West Chester, PA (US); Joseph K. Baker, Suwanee, GA (US); John M. Conner, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 364 days.

(21) Appl. No.: 11/584,273

(22) Filed: Oct. 20, 2006

(65) Prior Publication Data

US 2008/0093042 A1 Apr. 24, 2008

(51) Int. Cl.
*D21F 1/00* (2006.01)

(52) U.S. Cl. ..... 162/212; 162/123; 162/336; 162/345

(58) Field of Classification Search ..... 162/212, 162/123, 336, 345
See application file for complete search history.

(56) References Cited

U.S. PATENT DOCUMENTS

| | | | |
|---|---|---|---|
| 3,598,696 | A | 8/1971 | Beck |
| 3,802,960 | A | 4/1974 | Spengos et al. |
| 3,972,771 | A | 8/1976 | Notbohm |
| 4,358,342 | A | 11/1982 | Nuttall |
| 5,011,575 | A | 4/1991 | Keller |
| 5,133,836 | A | 7/1992 | Allen |
| 5,348,620 | A | 9/1994 | Hermans et al. |
| 5,501,768 | A | 3/1996 | Hermans et al. |
| 5,656,132 | A | 8/1997 | Farrington, Jr. et al. |
| 6,146,500 | A | 11/2000 | Hada et al. |
| 6,146,501 | A | 11/2000 | Beuther |
| 6,432,275 | B1 | 8/2002 | Huovila et al. |
| 6,464,833 | B2 | 10/2002 | Georger et al. |
| 6,761,801 | B2 | 7/2004 | Ruf et al. |
| 6,977,028 | B2 | 12/2005 | Russ et al. |
| 6,998,016 | B2 | 2/2006 | Yeh et al. |
| 2001/0018959 | A1 | 9/2001 | Aidun |
| 2002/0179268 | A1 | 12/2002 | Schwarz |
| 2003/0159791 | A1 | 8/2003 | Ronnila et al. |
| 2003/0183352 | A1 | 10/2003 | Schwaner et al. |
| 2005/0032452 | A1 | 2/2005 | Helwig |
| 2005/0039874 | A1 | 2/2005 | Halmschlager et al. |
| 2005/0150623 | A1 | 7/2005 | Bubik et al. |

FOREIGN PATENT DOCUMENTS

| | | |
|---|---|---|
| DE | 1 461 179 | 10/1969 |
| DE | 29713272 | 11/1997 |
| EP | 0434305 | 6/1991 |

OTHER PUBLICATIONS

International Search Resort for PCT/IB2007/053127.

*Primary Examiner*—Mark Halpern
(74) *Attorney, Agent, or Firm*—Dority & Manning, P.A.

(57) ABSTRACT

A multiple mode headbox is provided including a support surface, two or more chambers, and an adjustable roof. Each chamber includes a plurality of nozzles adapted to optionally supply papermaking fibers to the support surface. The adjustable roof is operably configured to adjust over a range of movement such that it defines a forming zone between the support surface and at least one chamber in a first mode, and between said support surface and at least one different said chamber in a second mode.

6 Claims, 4 Drawing Sheets

MULTIPLE MODE HEADBOX

BACKGROUND OF THE INVENTION

In the manufacture of paper sheets, including creped tissue paper, a headbox is used to deposit the papermaking stock onto a forming wire, where the stock is partially dewatered to form a paper web. While headboxes are well known in the art, a problem heretofore has been the inability to make very uniform sheets utilizing both high consistency and low consistency approach flows in a single headbox. As such, a need exists for a headbox that incorporates functionality to use both high consistency and low consistency flows to make uniform basis weight sheets.

SUMMARY OF THE INVENTION

Objects and advantages of the invention will be set forth in part in the following description, or may be obvious from the description, or may be learned through the practice of the invention.

The present disclosure is directed toward a multiple mode headbox which includes a support surface, two or more chambers, and an adjustable roof. The chambers include a plurality of nozzles, the nozzles being adapted to optionally supply papermaking fibers to the support surface. The adjustable roof is positioned to adjust over a range of movement such that it defines a forming zone between the support surface and at least one chamber in a first mode and between the support surface and at least one different chamber in a second mode.

In certain embodiments, the headbox also may include one or more distributors connected to each chamber, each distributor including pulp fibers, staple fibers, and mixtures thereof. The support surface may define apertures in communication with one or more vacuum boxes. The adjustable roof may define a forming zone between the support surface and one chamber. The forming zone may be suitable for forming a high consistency wood pulp sheet. The adjustable roof may define a forming zone between the support surface and at least two chambers in which the forming zone may be suitable for forming a low consistency long fiber sheet. The range of movement of the adjustable roof may be controlled by a controller. The adjustable roof may be positioned in a first planar region in the first mode and in a second planar region in the second mode.

In another exemplary disclosure, a multiple mode headbox is disclosed which includes a support surface, a first chamber and a second chamber, and an adjustable roof. Each chamber includes a plurality of nozzles, the nozzles being adapted to optionally supply papermaking fibers to the support surface. The adjustable roof is positioned to adjust over a range of movement such that a first mode defines a forming zone between the support surface, the first chamber, and the second chamber, and a second mode defines a forming zone between the support surface and the second chamber.

In still another exemplary embodiment of the present disclosure, a process for forming a web is disclosed which includes providing a headbox comprising a support surface, a first chamber, a second chamber, and an adjustable roof. The first chamber and the second chamber each include a plurality of nozzles, the nozzles being adapted to optionally supply papermaking fibers to the support surface. The adjustable roof is positioned to adjust over a range of movement. An aqueous suspension of fibers is supplied to the forming zone. A forming fabric is passed through the forming zone to receive the aqueous suspension of papermaking fibers. The adjustable roof is controlled such that a first mode defines a forming zone between the support surface, the first chamber, and the second chamber, and a second mode defines a forming zone between the support surface and the second chamber.

Other features and aspects of the present disclosure are discussed in greater detail below.

BRIEF DESCRIPTION OF THE DRAWINGS

A full and enabling disclosure of the present disclosure, including the best mode thereof to one of ordinary skill in the art, is set forth more particularly in the specification, including reference to the accompanying Figures in which.

Figure 1A:
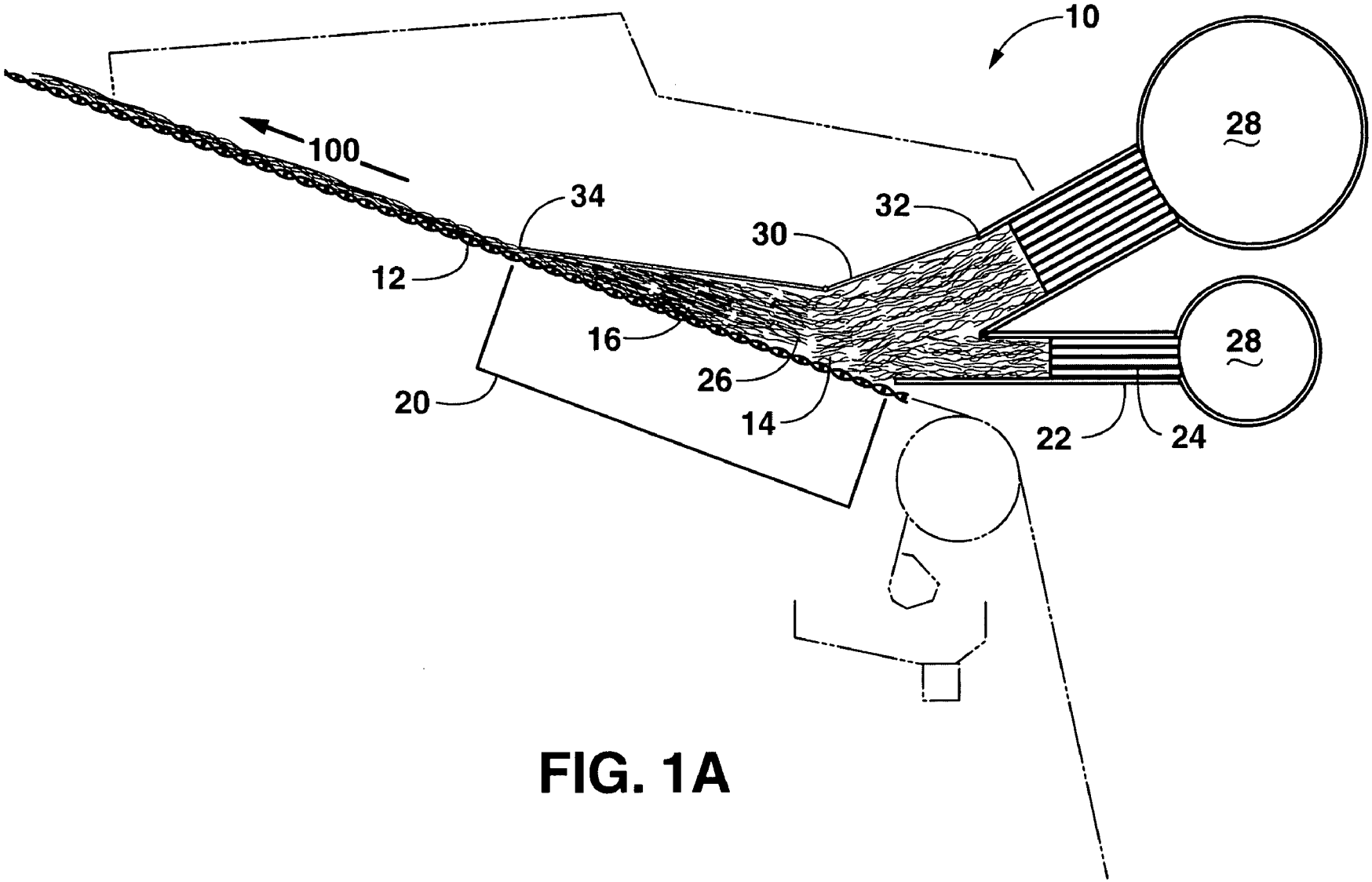
FIG. 1A represents one embodiment of a headbox for making paper webs in accordance with one embodiment of the present disclosure.

Repeat use of reference characters in the present specification and drawings is intended to represent the same or analogous features or elements of the present disclosure.

DETAILED DESCRIPTION

It is to be understood by one of ordinary skill in the art that the present discussion is a description of exemplary embodiments only, and is not intended as limiting the broader aspects of the present disclosure, which broader aspects are embodied in the exemplary construction.

The invention will now be described in greater detail with reference to FIGS. 1A,1B, 2A, and 2B which depict one embodiment of a multiple mode headbox 10 according to the present disclosure. As described in more detail as follows, a headbox of the present disclosure incorporates functionality to allow for production of both high consistency and low consistency paper sheets.

In this regard, the term "paper" is used herein to broadly include writing, printing, wrapping, sanitary, and industrial papers, newsprint, linerboard, tissue, napkins, wipers, towels, or the like. Paper webs can be manufactured using a variety of devices, such as suction breast roll formers, twin wire formers, crescent roll formers, or the like and any such devices can be used in connection with the present disclosure. Conventional papermaking apparatuses and operations as would be known in the art can be used with respect to the stock preparation, forming fabrics, web transfers, creping, drying and the like. Such conventional apparatuses and processes are well known to those skilled in the art and need not be discussed or illustrated in detail herein for an appreciation and understanding of the present invention.

FIGS. 1A, 1B, 2A, and 2B depict a headbox 10 for making a paper web from an aqueous suspension of papermaking fibers. The headbox 10 includes two chambers 22 that each have a plurality of nozzles 24. The nozzles 24 deposit the aqueous suspension of papermaking fibers 26 onto the surface of a forming fabric 12 in a forming zone 14. The forming fabric 12 forms an endless loop traveling between the headbox in the direction of arrow 100. The forming process allows partial dewatering of a newly-formed paper web to varying consistencies.

The headbox 10 includes a support surface 16 that defines a plurality of apertures 18. The apertures 18 can open to one or more vacuum boxes 20 located within the headbox 10 beneath the support surface 16 and operatively connected to a vacuum source. The vacuum box 20 provides a controlled amount of vacuum in the forming zone 14. The vacuum box 20 can include section dividers that divide the vacuum box 20 into multiple sections.

The headbox 10 receives a suspension of papermaking fibers through one or more distributors 28 operatively connected to the one or more chambers 22. Each distributor 28 can provide one or more types of fibers. Many fiber types may be used for the present disclosure including hardwood or softwoods, straw, flax, milkweed seed floss fibers, abaca, hemp, kenaf, bagasse, cotton, reed, and the like. All known papermaking fibers may be used, including bleached and unbleached fibers, fibers of natural origin (including wood fiber and other cellulosic fibers, cellulose derivatives, and chemically stiffened or crosslinked fibers) or synthetic fibers (synthetic papermaking fibers include certain forms of fibers made from polypropylene, acrylic, aramids, acetates, and the like), virgin and recovered or recycled fibers, hardwood and softwood, and fibers that have been mechanically pulped (e.g., groundwood), chemically pulped (including but not limited to the kraft and sulfite pulping processes), thermomechanically pulped, chemithermomechanically pulped, and the like. Mixtures of any subset of the above mentioned or related fiber classes may be used. As described previously, the nozzles 24 deposit the aqueous suspension of papermaking fibers 26 onto the surface of a forming fabric 12 in a forming zone 14.

The fibers can be prepared in a multiplicity of ways known to be advantageous in the art. Useful methods of preparing fibers include dispersion to impart curl and improved drying properties, such as disclosed in U.S. Pat. No. 5,348,620 issued Sep. 20, 1994 and U.S. Pat. No. 5,501,768 issued Mar. 26, 1996, both to M. A. Hermans et al. and U.S. Pat. No. 5,656,132 issued Aug. 12, 1997 to Farrington, Jr. et al.; which are incorporated herein by reference.

The headbox 10 also includes an adjustable roof 30 having a proximal edge 32 and an opposite distal edge 34. The adjustable roof 30 is configured to adjust over a range of movement. In this regard, the proximal edge 32 is connected to a chamber 22 such that the adjustable roof 30 defines a forming zone 14 between the support surface 16 and the chamber 22 to which the proximal edge 32 is connected. The adjustable roof 30 can be connected to the chamber by any method as would be known in the art including locking pins or the like. The sealing of the proximal edge 32 of the adjustable roof 30 can be accomplished by pressure pushing a sliding seal 36 against the chamber 22 to which the adjustable roof 30 is to be connected. The sliding seal 36 can be any material as would be known in the art so long as it serves to effectively seal the connection between the proximal edge 32 and the chamber 22. The adjustable roof 30 can also move by any method as would be known in the art including mechanical devices, hydraulics, pneumatics or the like. The movements of the adjustable roof 30 can be controlled by a computer controller such as a programmable logic controller or the like.

Figure 1B:
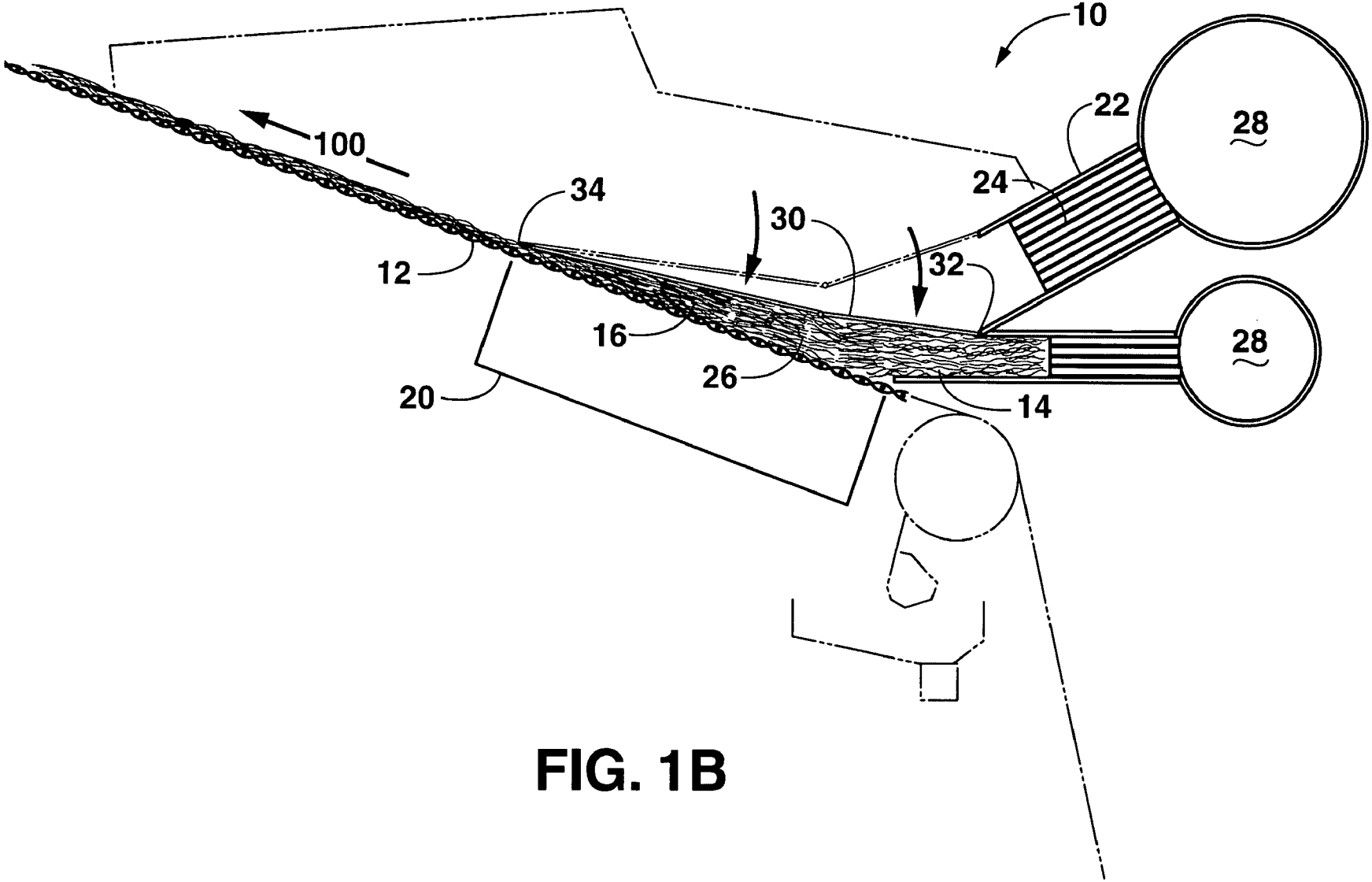
FIG. 1B is represents the embodiment illustrated in FIG. 1A with the roof of the headbox in an alternate position in accordance with one embodiment of the present disclosure.
Figure 2A:
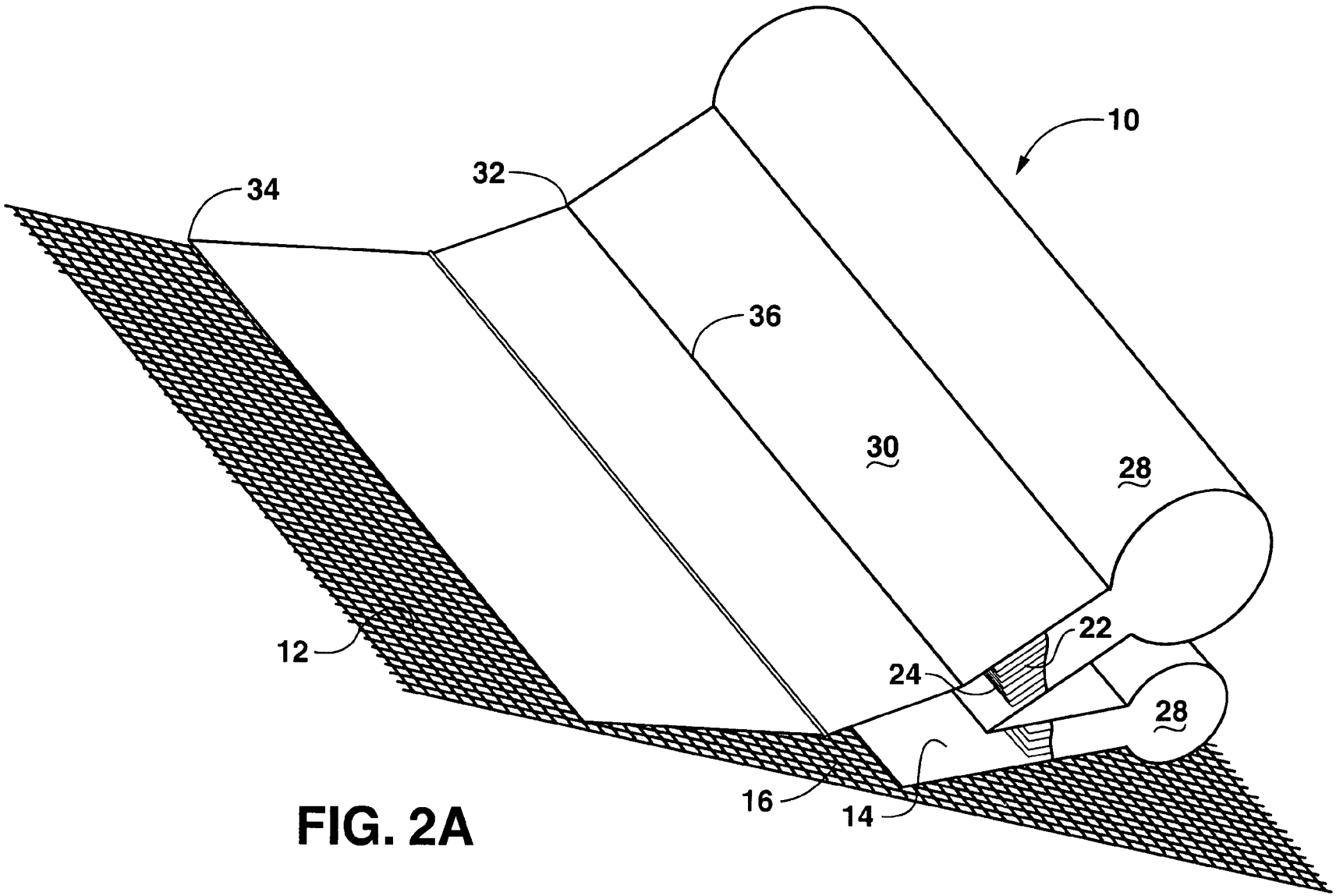
FIG. 2A represents a perspective view of the headbox of FIG. 1A in accordance with one embodiment of the present disclosure.
Figure 2B:
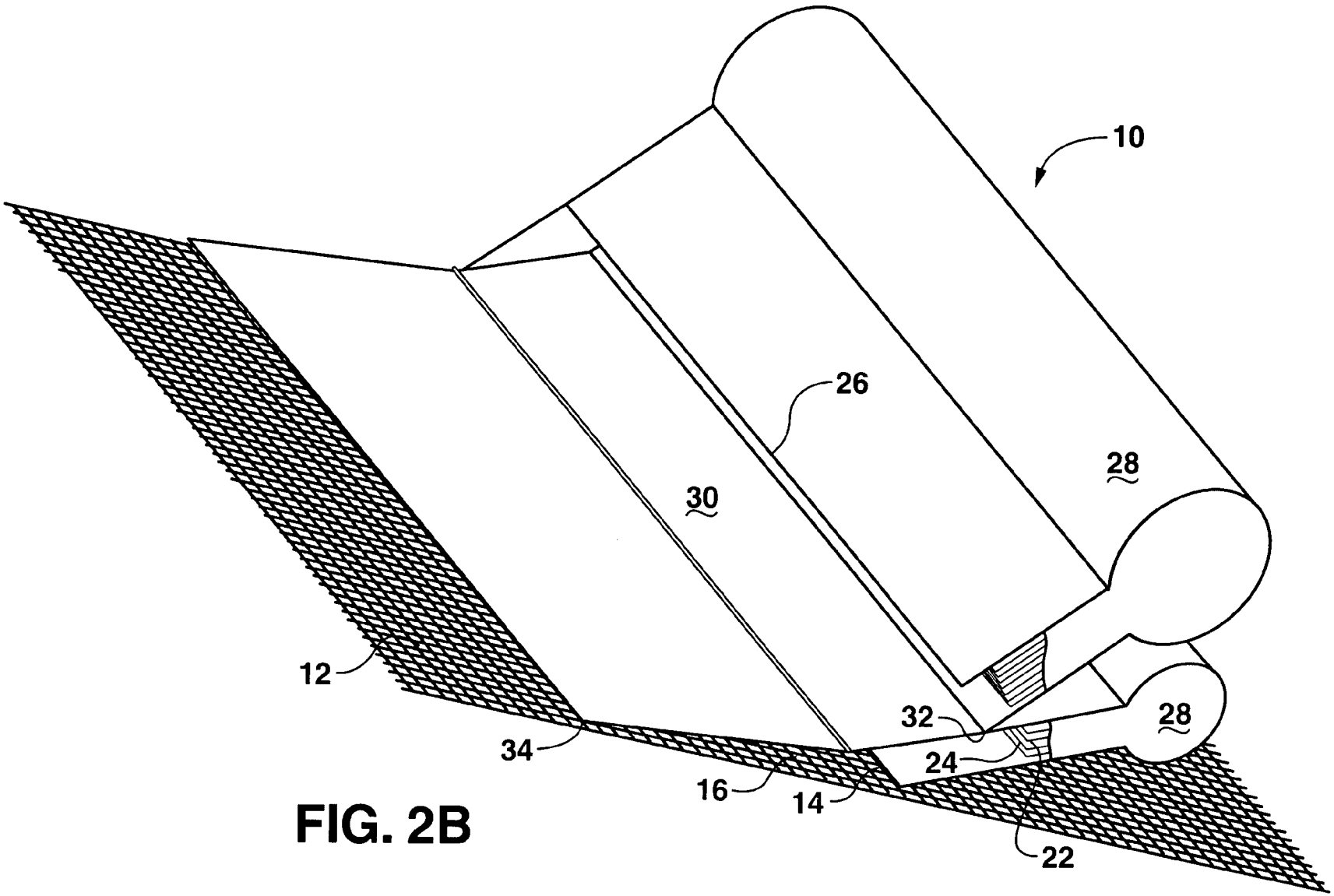
FIG. 2B is represents a perspective view of the headbox of FIG. 1B in accordance with one embodiment of the present disclosure.

It has been determined that the adjustable roof as described herein allows a single headbox the functionality to operate in multiple modes. For example, with reference to FIGS. 1A and 2A, a headbox is depicted in a low consistency mode in which the complete headbox is utilized to form long fiber sheets. The adjustable roof 30 is situated such that both chambers are enclosed in the forming zone 14 and the long forming distance results in low consistency sheets being formed. Referring to FIGS. 1B and 2B, the adjustable roof 30 is positioned such that only one chamber is enclosed in the forming zone 14, and as a result, this arrangement favors the formation of a high consistency sheet being formed. In this regard, the terms low consistency and high consistency refer to the consistency of sheet being formed as would be generally understood by one of ordinary skill in the art.

As depicted in FIGS. 1A, 1B, 2A, and 2B, the adjustable roof is positioned in a first planar region in the first mode and in a second planar region in the second mode.

The adjustable roof 30 can be straight, articulated or somewhat curved, with the distal edge 34 in close proximity to the support surface 16. For instance, the adjustable roof 30 can have a hinge point that allows the angle of the adjustable roof 30 to vary so as to allow control of the distance between the adjustable roof 30 and the support surface 16. The forming zone 14 is located between the adjustable roof 30 and the support surface 16. The distal edge 34 of the adjustable roof 30 may ride on the web as it is formed.

Under normal conditions, the expected contact between the adjustable roof 30 and the formed sheet operates to seal the vacuum box 20. Alternatively, the distal edge 34 of the adjustable roof may be spaced from the forming fabric, such as from about 0.8 to about 3 millimeters.

The length of the adjustable roof 30, measured between the proximal edge 32 and distal edges 34, is fixed. In some embodiments, the distance can be adjustable. For a roof of fixed length, the distal edge 34 of the roof after the stock has been dewatered may ride on the surface of the sheet, depending on the length of the forming zone required for that particular set of forming conditions.

In some embodiments, the adjustable roof 30 is formed from a rigid material having adequate durability and strength to operate in a commercial environment under the loads present. However, the adjustable roof 30 can also be formed from flexible materials. Suitable materials for forming the adjustable roof 30 include LEXAN (Polycarbonate, General Electric, Pittsfield, Mass.), glass or carbon-fiber reinforced epoxy resins, other polycarbonate materials, fiberglass or other composites, stainless steel or the like, where machining or fiber orientation can achieve the correct rigidity.

To improve web formation by creating turbulence within the suspension of papermaking fibers, the adjustable roof 30 may include turbulence generating features disposed on a surface of the adjustable roof 30 facing the forming zone 14. The turbulence generating features may include, for example, a plurality of projections extending outward from the inner surface of the adjustable roof 30 that are designed to provide micro-turbulence to the fluid flow near the roof surface, but without disturbing the sheet.

Another aspect of the invention concerns a method of forming a paper web. In one embodiment, the method includes providing a headbox that has a support surface, a first chamber, a second chamber, and an adjustable roof. The first chamber and said second chamber of the headbox each have a plurality of nozzles adapted to optionally supply papermaking fibers to the support surface and the adjustable roof is positioned to adjust over a range of movement. An aqueous suspension of fibers is supplied to the forming zone and a forming fabric is passed through the forming zone to receive the aqueous suspension of papermaking fibers. The adjustable roof is controlled such that a first mode defines a forming zone between the support surface, the first chamber, and the second chamber, and a second mode defines a forming zone between the support surface and one of the first or second chambers.

The web is formed on a forming fabric that travels through the forming zone between the adjustable roof and the support surface. The forming fabric is sandwiched between the support surface and a distal edge of the adjustable roof, with the forming fabric and the aqueous suspension generally traveling at the same speed. The term "forming fabric" refers to an endless mesh belt adapted to drain water away from the papermaking fibers and provide support as the web is being formed. Suitable forming fabrics comprise synthetic fabrics and are available from fabric suppliers such as Lindsay Wire and Albany International.

In particular embodiments, the method also includes the step of controlling the velocity of the aqueous suspension and the level of vacuum to achieve removal of water from the forming zone. The aqueous suspension that is under the adjustable roof is desirably under a slight positive pressure and thus positive pressure with respect to atmospheric pressure. The positive pressure will force water from the sheet through the fabric. The fluid will drain more slowly as the sheet builds on the fabric and resistance is increased.

There are a number of variables that will increase the length and/or time for the formation to take place under the adjustable roof. These include basis weight, speed, furnish, and consistency. The drainage of free water from the aqueous suspension should be completed before reaching the distal edge of the adjustable roof. To achieve complete drainage of free water, the operator can decrease the flow rate of the aqueous suspension, increase the vacuum, or change the length of the vacuum zone under the forming fabric.

The operating parameters of headbox such as vacuum levels, headbox orientation and other operating parameters such as the fan pump speed can be adjusted as will be recognized by those skilled in the art in order to achieve the desired sheet properties. The fiber type, fiber consistency, and other factors will need to be taken into consideration, but by the nature of the invention, are less critical to operation with improved formation.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for forming a web comprising:

supplying an aqueous suspension of fibers to a forming zone of a headbox, the headbox being positioned over a forming fabric and comprising a first chamber, a second chamber, and an adjustable roof, the first chamber and the second chamber each comprising a plurality of nozzles adapted to supply the aqueous suspension of fibers to the forming zone, the adjustable roof configured to adjust over a range of movement such that in a first mode, the forming zone is defined by the adjustable roof, the forming fabric, and at least the first chamber, and in a second mode, the forming zone is defined by the adjustable roof, the forming fabric, and at least the second chamber;

adjusting the adjustable roof from the first mode to the second mode.

2. A process as defined in claim 1, wherein the forming zone defined in the second mode is suitable for forming a high consistency wood pulp sheet.

3. A process as defined in claim 1, wherein the forming zone defined in the first mode is suitable for forming a low consistency wood pulp sheet.

4. A process as defined in claim 1, wherein the forming zone defined in the first mode is suitable for forming a long fiber sheet.

5. A process as defined in claim 1, wherein the range of movement of the adjustable roof is controlled by a controller.

6. A process as defined in claim 1, wherein the adjustable roof is moved by a hydraulic device.

* * * * *